US008307768B2

(12) United States Patent
Cziglenyi

(10) Patent No.: US 8,307,768 B2
(45) Date of Patent: Nov. 13, 2012

(54) PROJECTILES AND METHODS FOR FORMING PROJECTILES

(76) Inventor: Joseph Cziglenyi, Spokane, WA (US)

( * ) Notice: Subject to any disclaimer, the term of this patent is extended or adjusted under 35 U.S.C. 154(b) by 1247 days.

(21) Appl. No.: 11/709,510

(22) Filed: Feb. 21, 2007

(65) Prior Publication Data

US 2008/0196616 A1 Aug. 21, 2008

(51) Int. Cl.
*F42B 30/02* (2006.01)

(52) U.S. Cl. ..... 102/517; 102/506; 102/510; 102/439

(58) Field of Classification Search ..... 102/517, 102/501, 439, 506, 507, 508, 509, 510; 86/54
See application file for complete search history.

(56) References Cited

U.S. PATENT DOCUMENTS

| | | | | | |
|---|---|---|---|---|---|
| 34,285 | A * | 1/1862 | Mefford | 102/517 |
| 44,492 | A * | 9/1864 | Williams | 102/525 |
| 216,974 | A * | 7/1879 | Rice | 102/506 |
| 627,929 | A * | 6/1899 | Andrews et al. | 102/511 |
| 926,431 | A * | 6/1909 | Luger | 102/438 |
| 2,792,618 | A * | 5/1957 | Walker | 86/55 |
| 3,003,420 | A * | 10/1961 | Nosler | 102/508 |
| 4,083,306 | A * | 4/1978 | Woodring | 102/439 |
| 4,538,520 | A * | 9/1985 | Schmitz | 102/439 |
| 4,750,427 | A * | 6/1988 | Carter | 102/516 |
| 4,779,535 | A * | 10/1988 | Maki | 102/501 |
| 4,958,570 | A * | 9/1990 | Harris | 102/517 |
| 5,097,767 | A * | 3/1992 | Cirillo | 102/506 |
| 5,099,765 | A | 3/1992 | Czetto | |
| 5,149,913 | A * | 9/1992 | Arakaki | 102/506 |
| 5,385,101 | A * | 1/1995 | Corzine et al. | 102/509 |
| 5,476,045 | A * | 12/1995 | Chung et al. | 102/529 |
| 6,244,187 | B1 | 6/2001 | Head | |
| 6,439,125 | B1 | 8/2002 | Carter | |
| 6,561,070 | B2 | 5/2003 | Weber | |
| 6,776,101 | B1 | 8/2004 | Pickard | |
| 6,792,869 | B2 | 9/2004 | Pi | |
| 6,805,057 | B2 | 10/2004 | Carr et al. | |
| 6,837,165 | B2 | 1/2005 | Eberhart et al. | |
| 6,845,717 | B1 | 1/2005 | Sauvestre | |
| 6,964,232 | B2 | 11/2005 | Eberhart et al. | |
| 7,210,412 | B2 * | 5/2007 | O'Dwyer | 102/523 |
| 7,503,260 | B2 * | 3/2009 | Kapeles | 102/502 |

* cited by examiner

*Primary Examiner* — James Bergin
(74) *Attorney, Agent, or Firm* — Wells St. John P.S.

(57) ABSTRACT

A bullet for a firearm includes a rear unit that comprises substantially a solid structure. Additionally, the bullet includes a front unit separate and discrete from the rear unit. The front unit defines a cavity and at least a portion of the rear unit is secured in the cavity of the front unit.

9 Claims, 13 Drawing Sheets

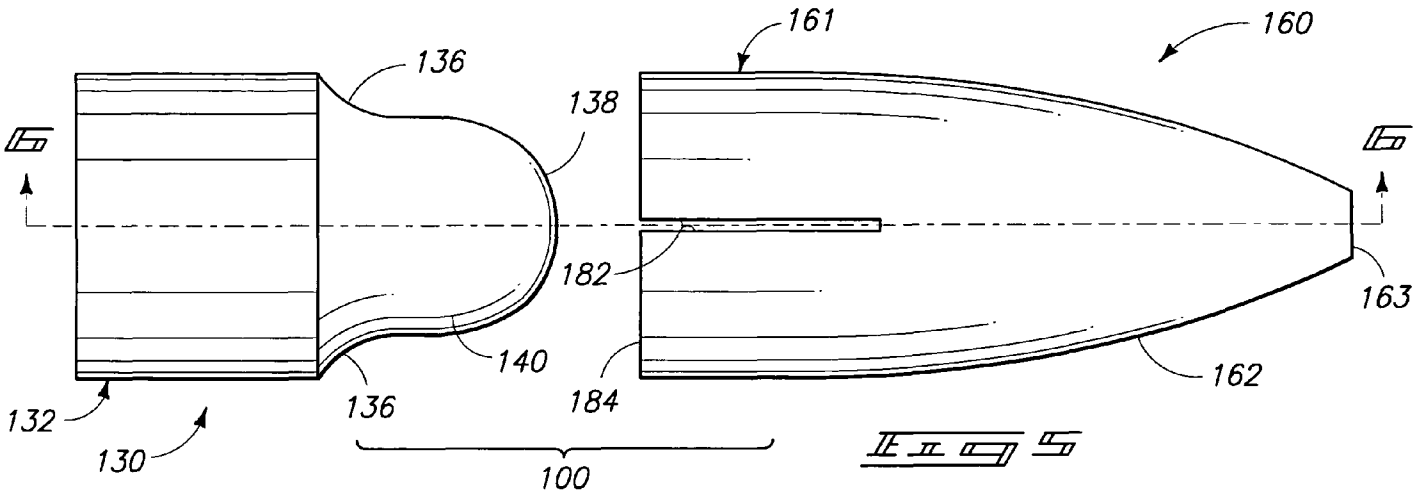
160
161
163
162
182
184
138
136
140
136
130
132
100
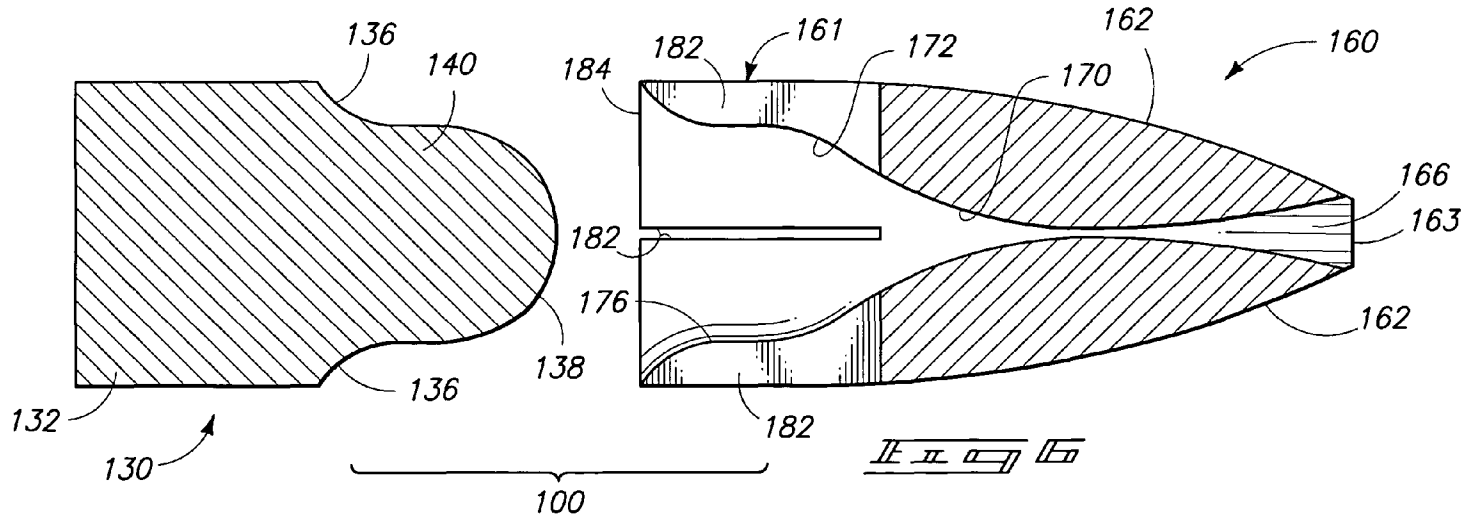
160
166
163
162
162
170
172
161
182
184
182
176
182
138
140
136
136
130
132
100

PROJECTILES AND METHODS FOR FORMING PROJECTILES

TECHNICAL FIELD

This invention relates to projectiles and methods for forming projectiles, with exemplary projectiles for use in firearms.

BACKGROUND OF THE INVENTION

When considering design specifications for a projectile such as a bullet, the target to be impacted by the bullet must be considered. For example, design specifications of a bullet for sport, such as target practice, would be different from design specifications for a bullet used by the military, police and/or for wildlife harvest. Moreover, each category listed can have different concerns and influences that alter or differentiate design considerations and specifications of a bullet, for example, consider wildlife harvest. The different physiologies of various wildlife species warrant different design specifications for a bullet to ensure consistent and repeated incapacitation of the animal for harvest. That is, bullets designed for harvesting large and/or thick-skinned animals such as elephants, rhinos and buffalo warrant different design considerations to incapacitate the animal than bullets designed for harvesting medium-sized and/or thin-skinned animals such as elk, moose and bear. Still further, bullets designed for harvesting small-sized animals such as deer, antelope and sheep warrant different engineering considerations to incapacitate the animal than bullets designed for large- and medium-sized animals, and including thick-skinned animals.

The design of a bullet for wildlife harvest warrants design considerations for a bullet that consistently incapacitates the animal quickly, humanely and with permanence. If an animal is not incapacitated quickly and/or permanently, the animal routinely recovers sufficiently to run from the location of bullet impact and is routinely lost. In fact, the Idaho Fish and Game Department published statistical data that stated for every one hundred (100) big game animals shot by legal hunters, fifty (50) of the animals were lost and never found. Accordingly, conventional bullet designs for wildlife harvest fail to consistently incapacitate the animal quickly and permanently to sufficiently enable capture of the animal.

Conventional bullet designs are single unit projectiles wherein at least two parameters are routinely varied to optimize killing power. The velocity of the bullet can be increased to optimize the penetration capability of the bullet into the animal. Furthermore, the expansion of the diameter of the bullet upon impact with the animal can be increased to optimize impact capabilities of the bullet. However, varying one parameter to optimize killing power ultimately affects the other capability detrimentally. For example, a conventional bullet designed to optimize velocity and penetration will routinely decrease the diameter expansion capability of the bullet. Conversely, a conventional bullet designed to increase diameter expansion capabilities will routinely decrease the penetration capabilities of the bullet. Conventional bullet designs routinely do not optimize both goals in the same bullet design.

Consequently, there is a need to improve bullet designs for wildlife harvest to consistently incapacitate the animals quickly, humanely and permanently allowing for capture and harvest. Furthermore, there is a need to design bullets capable of consistently incapacitating the various wildlife species having different physiologies using a single bullet design.

Still further, there is a need to design a bullet that optimizes expansion capabilities and penetration capabilities in a single bullet design.

SUMMARY OF THE INVENTION

In one aspect, the invention includes a bullet for a firearm. The bullet includes a rear unit that comprises substantially a solid structure. Additionally, the bullet includes a front unit separate and discrete from the rear unit. The front unit defines a cavity and at least a portion of the rear unit is secured in the cavity of the front unit.

In another aspect of the invention, a cartridge for a firearm comprises a solid structure having a rear portion and a front portion extending from the rear portion. A hollow structure defines a bore in fluid communication with a cavity, the cavity is defined at one end of the hollow structure. At least a segment of the front portion of the solid structure is secured in the cavity of the hollow structure. The cartridge includes a casing having a propellant and an open end. The rear portion of the solid structure is secured in the open end. A primer is configured in igniting relationship with the propellant.

In still another aspect of the invention, a method of forming a bullet for a firearm is disclosed. The method includes forming an ogival unit defining an opening at one end. The method further includes forming a solid unit, the solid unit being separate and discrete from the ogival unit. The method includes securing at least a portion of the solid unit in the opening of the ogival unit.

BRIEF DESCRIPTION OF THE DRAWINGS

Preferred embodiments of the invention are described below with reference to the following accompanying drawings.

FIG. 5 illustrates a side elevational view of another exemplary projectile or bullet according to another of various embodiments of the invention.

FIG. 6 illustrates a cross-sectional view of an exemplary bullet according to another of various embodiments of the invention taken along line 6-6 of FIG. 5.

FIG. 14 illustrates a cross-sectional view of an exemplary rear unit of an exemplary bullet and demonstrating exemplary dimensions for the rear unit according to one of various embodiments of the invention.

DETAILED DESCRIPTION OF THE PREFERRED EMBODIMENTS

Figure 1:
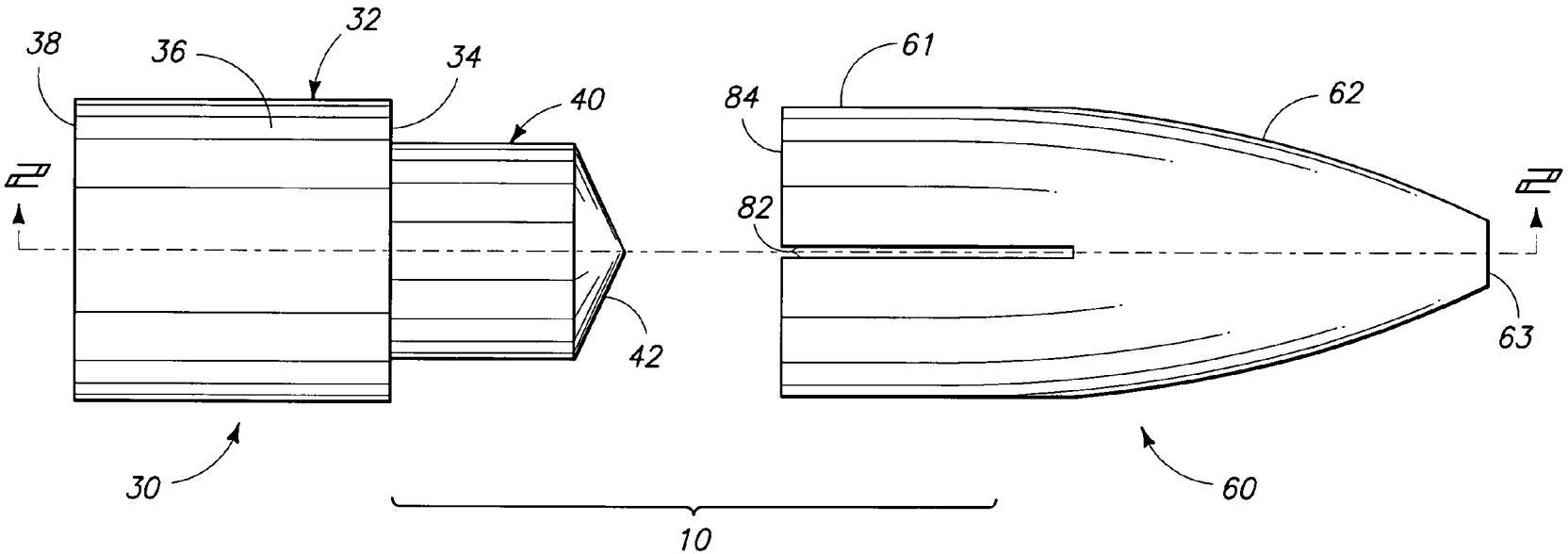
FIG. 1 illustrates a side elevational view of one exemplary projectile or bullet according to one of various embodiments of the invention.

This disclosure of the invention is submitted in furtherance of the constitutional purposes of the U.S. Patent Laws "to promote the progress of science and useful arts" (Article 1, Section 8).

The impact effects of a bullet on the physiology of an animal must be understood to optimize the design of a bullet that consistently incapacitates the animal effectively for harvest. However, this information is not generally known and understood by the bullet designing industry. This lack of information is understandable because investigation and research into the physiological effects of the impact by a bullet on living animals is not practical or humane. However, the inventor has gained extensive knowledge as a former professional hunter and wildlife biologist, and from his education, to be able to make useful characterizations of the physiological impact of a bullet on a living animal. With these useful characterizations, the inventor has designed a bullet that efficiently and humanely incapacitates an animal quickly and permanently.

The physiological-related impacts by a bullet on a living animal can be divided into two groups, trauma shock and hydro-shock. Trauma shock represents the effect on solid matter of the body and hydro-shock represents the effect on fluids in the body such as blood, particularly resulting from impacting muscle tissue. The bullet industry has not fully understood these effects on a living animal, and therefore, these effects are not thoroughly considered when designing a bullet for effective animal harvest.

The trauma shock effect can be divided into at least three subsets characterized by the physiological systems and/or organs of a living animal that are impacted by the bullet. A first subset includes effects on an animal when a bullet strikes the kidney, liver, heavy bone and/or stomach. Bullets that strike this first subset of organs and/or body structures will routinely allow the animal to recover after being shot to walk or run from the location of impact and subsequently die after several hours, or even days, while in miserable pain. This type of bullet impact on an animal is a common occurrence during a hunting trip, and therefore, the animal is lost for harvesting purposes.

A second subset of the trauma shock effect includes effects on an animal when a bullet strikes the brain, spine (or backbone) and/or neck bone. Bullets that strike this second subset of organs and body structures will routinely incapacitate the animal, without recovery, and the animal will routinely die within minutes. However, this type of bullet impact is not a common occurrence.

A third subset of the trauma shock effect can be referred to as an "empty chamber shot." The empty chamber shot can be understood with a more thorough discussion of the physiology of an animal. The chest cavity holds the lungs and is sized to secure the lungs during both the exhale and inhale conditions of the lungs. Accordingly, the chest cavity is large enough to hold the lungs in the inhaled condition. Moreover, during exhale of the lungs with the lung capacity being at a minimum, the lungs rest on the bottom of the chest cavity creating empty space in approximately a third (⅓) of the chest cavity above the lungs. The empty space is defined between the lungs and the spine bone (backbone). When a bullet enters the chest cavity during the exhale condition, the conventional bullet will routinely enter the empty space above the lungs and below the spine bone and punch holes in opposite sides of the chest wall to exit the animal's body. Additionally, if the bullet strikes the ribs, the strike will routinely provide a heavy blow or hammering effect to the spine bone and central nervous cord housed therein. The effect on the central nervous system results in the animal falling unconscious immediately upon impact by the bullet. However, in about 15 to 20 seconds, the animal starts to recover, and recovers sufficiently to run from the impact location to be lost for harvesting purposes. In fact, this animal has a good chance to recover from the injury completely.

Regarding the hydro-shock effect, it should be understood that muscle substantially comprises fluid in the form of liquid such as blood (90% water). When a physical force impacts the surface of a muscle, such as a bullet, the muscle will shrink from its original size and force liquid/blood from the muscle tissue into adjacent tissues or systems of the body. The released liquid/blood rushes to adjacent tissues of the body, particularly blood vessels, veins and arteries, and expands the size and volume of the blood vessels, veins and arteries. Subsequently, the blood returns to the muscle by the pumping action of the heart while the tissue of the blood vessels, veins, arteries remain expanded from their original size and volume. The expansion remains for a period of time after the blood returns to the muscle tissue causing blood pressure in the animal to drop sufficiently to cause immediate unconsciousness.

For example, a desired target area for a healthy adult animal, such as a deer, is in the middle of the shoulder. The shoulder is covered by heavy, thick muscle. An accurate shot will have the bullet impact the shoulder and affect about one square foot area of body to the depth in the body that the bullet travels. Hydro-shock begins. Blood rushes out of the impacted region of the animal into adjacent tissues of the body. It should be understood there is no immediate and significant blood loss out of the body as the body can handle such puncture wounds, at least initially. Accordingly, the animal runs for about 50 to 150 yards, for an exemplary time span of about 5-15 seconds. The blood rushes back to the impacted region, blood pressure drops, the animal slows down and eventually falls to the ground unconsciousness. This condition stays in effect for about another 30 seconds, and during this period of unconsciousness, the animal's body relaxes which allows bleeding to increase. As a result, blood pressure continues to decrease preventing the animal from recovering consciousness wherein the animal dies of blood loss.

The above discussion is relative to the conventionally designed bullets. To facilitate the goals listed in the "Background" section, bullet designs need to be implement that optimize hydro-shock and trauma shock without changing or modifying the caliber, velocity and deformation capability of the bullet.

Referring to FIG. 1, an exemplary projectile or bullet 10 according to one of various embodiments of the invention is described. An exemplary bullet 10 comprises a first or rear unit 30 configured to be secured with a second or front unit 60 along a longitudinal axis shown as sectional line 2-2. One of various exemplary embodiments of the rear unit 30 comprises a substantially solid construction or configuration of material and is separate and discrete from front unit 60. Alternatively, another exemplary embodiment of rear unit 30 has a hollow construction. An exemplary embodiment of rear unit 30 has a main or exterior (or first) portion 32 and a second or interior portion 40 that extends from a first surface or wall 34 of the exterior portion 32. An exemplary exterior portion 32 includes an outer surface 36 that extends from first wall 34 to an opposite second surface or wall 38. Exterior portion 32 can include any vertical (or perpendicular relative axis 2-2) cross-sectional configuration, for example, a circular configuration wherein exterior portion 32 comprises a cylindrical outer surface 36. One of various exemplary embodiments of the rear unit 30 comprises a single structure or single mass of material wherein interior portion 40 is integral with exterior portion 32. Alternatively, another exemplary embodiment of the rear unit 30 includes interior portion 40 being a separate and discrete structure that is secured to exterior portion 32, and in one exemplary embodiment, secured to first wall 34 of exterior portion 32.

Still referring to FIG. 1, one of various exemplary embodiments of the interior portion 40 has interior portion 40 extending axially from, and centered on, first wall 34 of exterior portion 32. Interior portion 40 can have any vertical (perpendicular relative axis 2-2) cross-sectional configuration, for example, a circular configuration. It should be understood that interior portion 40 can comprise any configuration, for example, a square, rectangle, cylinder, sphere, pyramid, tetrahedron, prism and any combination of such configurations. An exemplary interior portion 40 is configured to have at least a portion to extend at least partially into front unit 60. Another exemplary interior portion 40 is configured to have a substantial portion to extend at least partially into front unit 60. Still another exemplary interior portion 40 is configured to have at least a portion to extend substantially entirely through an axial length of the front unit 60. Interior portion 40 can be configured to extend into front unit 60 for any selected distance along the axial length of front unit 60. Since a portion of rear unit 30 is configured to positioned to extend into front unit 60, rear unit 30 can be referred to as an interior unit and front unit 60 can be referred to as an exterior unit.

Still referring to FIG. 1, an exemplary rear unit 30 has an exemplary interior portion 40 that includes an exemplary end portion 42 which in this embodiment is configured as a cone. It should be understood that end portion 42 can comprise any configuration, for example, a square, rectangle, cylinder, sphere, pyramid, tetrahedron, prism, planar, convex or concave (curved inwardly or outwardly) relative axis 2-2 and any combination of such configurations. It should be understood that interior portion 40 can be formed without end portion 42 leaving first wall 34 as a front-most portion of rear unit 30. It should be further understood that rear unit 30 can be configured without interior portion 40 wherein first wall 34 is secured to front unit 60.

Still referring to FIG. 1, one of various exemplary embodiments of front unit 60 comprises a receiving end 84 which is configured to receive interior portion 40 of rear unit 30. Accordingly, after front unit 60 receives rear unit 30, receiving end 84 will be positioned adjacent rear unit 30, for example, adjacent the first wall 34 of rear unit 30. For one exemplary embodiment of projectile 10, first wall 34 can act as a shoulder to directly support front unit 60 with first wall 34 directly contacting receiving end 84. Another exemplary embodiment has receiving end 84 being spaced any selected distance from first wall 34 of rear unit 30 after front unit 60 is position in receipt of rear unit 30. An exemplary embodiment of front unit 60 has a first periphery portion 61 extending axially from the receiving end 84 and a second periphery portion 62 extending from the first periphery portion 61 in an inwardly sloping configuration. The second periphery portion 62 terminates to form a front end 63 of front unit 60 wherein front end 63 has a smaller dimension than receiving end 84 in a direction perpendicular to axis 2-2. Accordingly, for one of various exemplary embodiments of first and second periphery portions 61 and 62, first and second periphery portions 61 and 62 comprise different respective vertical cross-sectional dimensions. An exemplary first periphery portion 61 has a circular configuration to form a cylinder. An exemplary second periphery portion 62 has a circular configuration with a continually decreasing or diminishing diameter as the second periphery portion 62 extends from the first periphery portion 61 to the front end 63.

Still referring to FIG. 1, one of various exemplary embodiments of front unit 60 has a slot 82 extending axially from receiving end 84 and terminates at any selected distance from receiving end 84. Other exemplary embodiments of slot 82 do not begin at receiving end 84, and therefore, begin at any selected distance from receiving end 84. Still other exemplary embodiments of slot 82 extend to terminate at any selected distance from front end 63.

Figure 2:
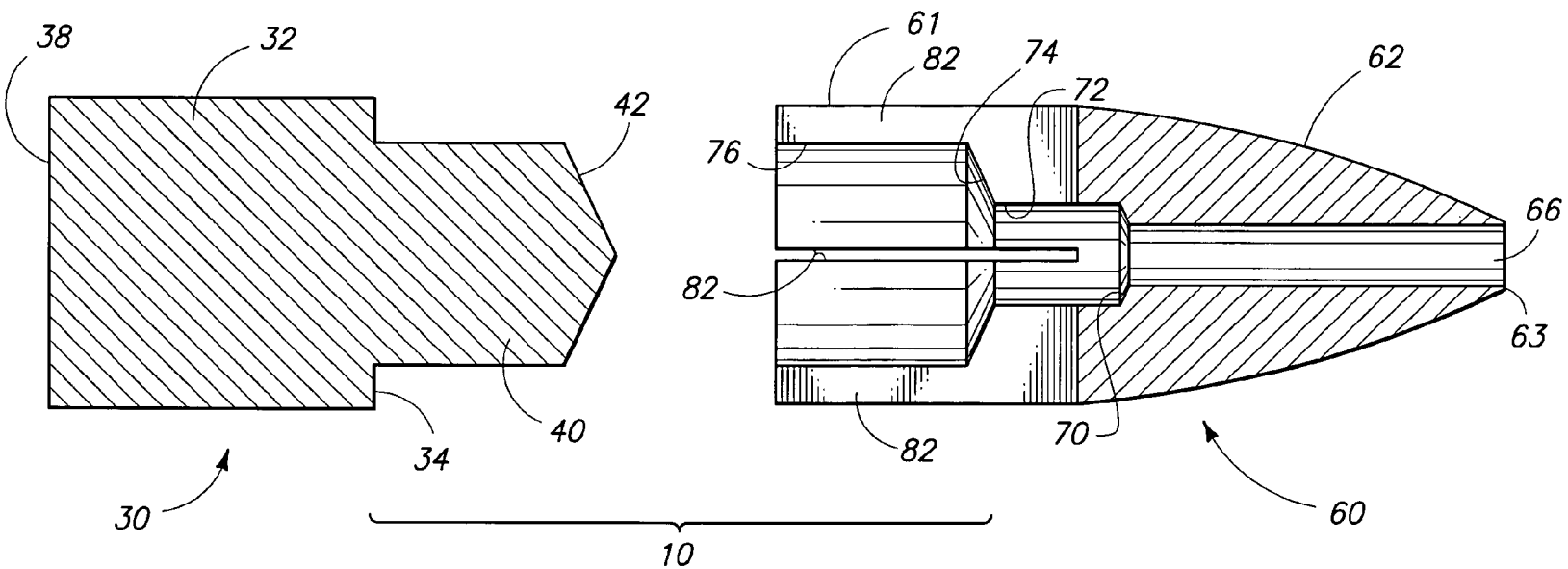
FIG. 2 illustrates a cross-sectional view of an exemplary bullet according to one of various embodiments of the invention taken along line 2-2 of FIG. 1.

Referring to FIG. 2, one of various exemplary embodiments of projectile 10 is shown in an exemplary horizontal cross-section along longitudinal axis line 2-2 of FIG. 1. An exemplary rear unit 30 includes a substantially solid and single structure and is configured to remain substantially intact upon impacting a substrate, for example, an animal. Moreover, an exemplary rear unit 30 is configured to optimize penetration into the body of an animal. Other exemplary rear units 30 can have selected mass portion(s) removed or bored out from rear unit 30 to provide different selected masses for rear unit 30.

Still referring to FIG. 2, an exemplary front unit 60 defines a first cavity 76 beginning at receiving end 84 and extending axially toward front end 63. First cavity 76 leaves receiving end 84 formed substantially as a rim of front unit 60. An exemplary front unit 60 further defines a second cavity 74 extending from first cavity 76 and toward front end 63, a third cavity 72 extending from second cavity 74 and toward front end 63, and a fourth cavity 70 extending from third cavity 72 and toward front end 63. Exemplary cavities 76, 74, 72, 70 are in fluid communication and configured to receive various selected segments of interior portion 40 of rear unit 30. Exemplary cavities 76 and 72 are defines by interior or inner walls of front unit 60 that form cylindrical openings. Exemplary cavities 74 and 70 are defined by interior or inner walls of front unit 60 that extend inwardly from respective cavities 76 and 72. That is, the inner walls forming cavities 74 and 70 are angled inwardly from the inner wall forming respective cavities 76 and 72.

Moreover, an exemplary front unit 60 defines an exemplary opening or bore 66 extending axially from fourth cavity 70, and in fluid communication, to front end 63. One exemplary configuration of opening 66 is cylindrical. In various other exemplary embodiments, the cross-sectional dimensions (perpendicular to line 2-2 of FIG. 1) of cavities 76, 74, 72, 70 can have different configuration. Additionally, the cross-sectional dimensions (perpendicular to line 2-2 of FIG. 1) of opening 66 can vary along its length (see FIG. 6). It should be understood that configurations of cavities in front unit 60 and configurations of interior portion 40 of rear unit 30 must be compatible for interior portion 40 to be positioned in front unit 60.

Figure 3:
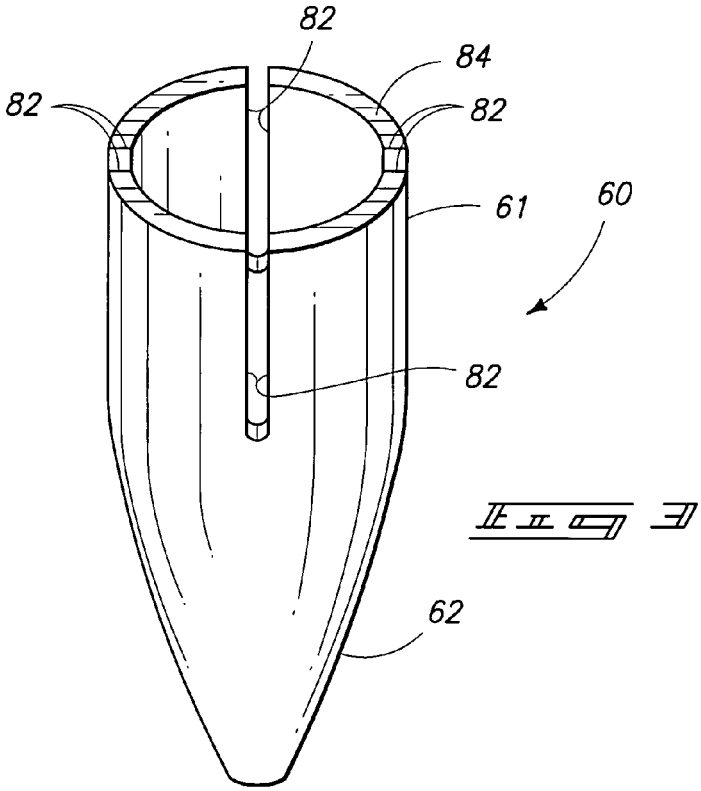
FIG. 3 illustrates a perspective view of an exemplary front or exterior unit of an exemplary projectile or bullet according to one of various embodiments of the invention.

Referring to FIG. 3, one of various exemplary embodiments of front unit 60 has a plurality of slots 82. An exemplary number of slots 82 include, for example, four slots 82 circumferentially-spaced around an exemplary peripheral circumference of front unit 60. In one exemplary embodiment, slots 82 can be equally spaced circumferentially around front unit 60. Alternatively, a plurality of slots 82 are circumferentially-spaced an unequal distance around front unit 60. Furthermore, exemplary slots 82 are configured to extend radially from cavities 76, 74 and 72, that is, in fluid communication (see also FIG. 2). An exemplary number of slots 82 includes a range of less than two slots to greater than twenty slots, for example, a range from three slots to eights slots. With respective cavities, slots and bore, an exemplary front unit 60 is configured to fracture into a plurality of sections upon impacting a substrate, for example, an animal. For the exemplary front unit 60 having four slots 82, front unit 60 is configured to facture into four separate fragments upon impact wherein the four fragments become separate and discrete projectiles to provide additional trauma and hydro-shock to the body of the animal.

Figure 4:
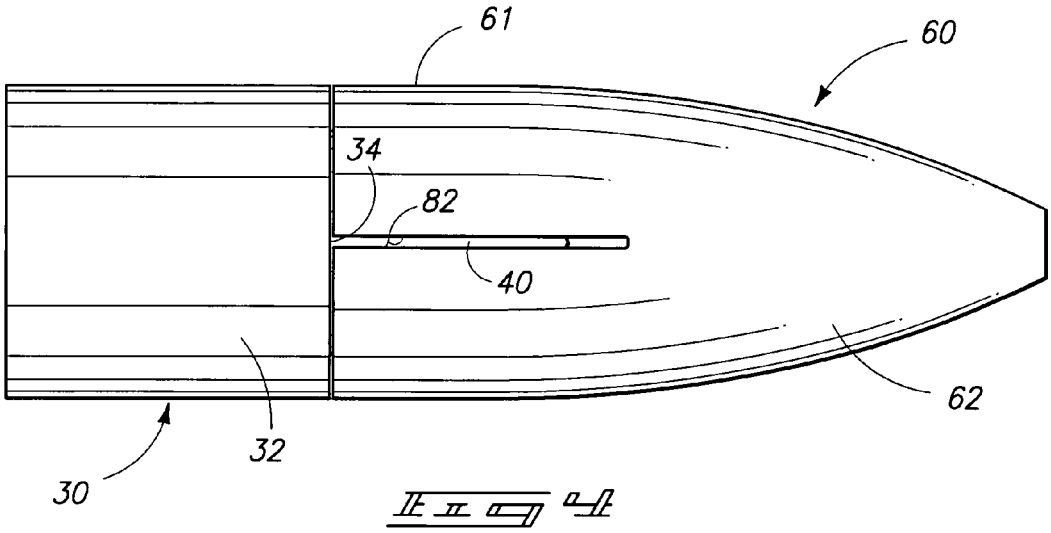
FIG. 4 illustrates a side elevational view of an exemplary rear unit mated with an exemplary front unit to form an exemplary projectile or bullet according to one of various embodiments of the invention.

Referring to FIG. 4, one of various exemplary embodiments of bullet or projectile 10 is illustrated with the rear unit 30 mated or secured with the front unit 60. The interior portion 40 of rear unit 30 is positioned in at least the first cavity 76 of front unit 60. An adhesive material or agent (not shown) is provided between selected sections of interior portion 40 and/or first cavity 76 of front unit 60 to secure the rear and front units together sufficiently to handle the spinning motion provided when bullet 10 is fired from a firearm. An exemplary angular velocity of a bullet fired from a rifle is 200,000 revolutions per minute (rpm). An exemplary adhesive material is wire solder which comprises, for example, 50% tin and 50% lead wire solder. In an exemplary embodiment, adhesive can be provided on any portion of interior portion 40 including end portion 42. For other various exemplary embodiments of providing adhesive, adhesive can be provided only on first wall 34, or only on receiving end 84, or only on interior portion 40, or only in one of the various cavities of front unit 60, or by selecting any combination of these sites for providing adhesive.

It should be understood that front unit 60 can have first and second periphery portions 61 and 62 that are substantially different from those illustrated in FIGS. 1-4. In various other embodiments, front unit 60 can have various round configurations, various pointed configurations and/or ogival configurations, and all various exemplary configurations can have various lengths. Moreover, it should be understood that rear and front units 30 and 60 can comprise the same respective material compositions, or have different respective compositions. Exemplary material compositions for rear and front units 30 and 60 include metals and plastics and various combinations thereof. Various exemplary metals include bronze, copper, tin, lead, antimony (Sb) and any combinations or alloys thereof. It should be further understood that vertical cross-sectional dimensions (diameters relative line 2-2) of exterior portion 32 (of rear unit 30) and first periphery 61 (of front unit 60) can comprise the same respective dimensions, or have different respective dimensions. If the respective dimensions are configured differently, one of the two dimensions is configured to support bullet 10 as it travels down the barrel of a firearm. It should be understood that opening 66 of front unit 60 can be filled with a fluid such as a gas or liquid. It should be further understood that opening 66 of front unit 60 can be filled with a solid material, for example, bronze, copper, tin, lead, antimony (Sb) and any combinations or alloys thereof. It should be understood that opening 66 and any portion of first, second, third and fourth cavities of front unit 60 can be provided with a fluid such as a gas or liquid, and/or a solid material such as bronze, copper, tin, lead, antimony (Sb) and any combinations or alloys thereof.

It should be understood that at least one of the rear and front units 30 and 60 has an outer peripheral configuration dimensioned to be slidingly secured in a barrel of a firearm. Alternatively, both of the rear and front units 30 and 60 have an outer peripheral configuration dimensioned to be slidingly secured in a barrel of a firearm. It should be understood that rear unit 30 can be referred to as a solid structure and front unit 60 can be referred to as a hollow structure.

Referring to FIG. 5, an exemplary projectile or bullet 100 according to another of various embodiments of the invention is described. An exemplary bullet 100 comprises a first or rear unit 130 configured to be secured with a second or front unit 160 along a longitudinal axis shown as sectional line 9-9. One of various exemplary embodiments of the rear unit 130 comprises a substantially solid construction or configuration of material and is separate and discrete from front unit 160. Alternatively, another exemplary embodiment of rear unit 130 has a hollow construction (not shown) to allow the capability to vary the mass of rear unit 130. An exemplary embodiment of rear unit 130 has a main or exterior (or first) portion 132 and a second or interior portion 140 that extends from exterior portion 132. This exemplary embodiment of rear unit 130 does not have the first wall 34 of exterior portion 32 of exemplary bullet 10 disclosed in FIGS. 1-4. Exemplary interior portion 140 has curved or arcuate surfaces 136 and curved front face 138. One of various exemplary embodiments of the rear unit 130 comprises a single structure of material wherein interior portion 140 is integral with exterior portion 132. Alternatively, another exemplary embodiment of interior portion 140 is a separate and discrete structure that is secured to exterior portion 132.

Still referring to FIG. 5, one of various exemplary embodiments of the interior portion 140 has interior portion 140 extending axially from, and centered on, exterior portion 132. Interior portion 140 can have any vertical (perpendicular relative axis 2-2) cross-sectional configuration. It should be understood that interior portion 140 can comprise any configuration, for example, a square, rectangle, cylinder, sphere, pyramid, tetrahedron, prism and any combination of such configurations. An exemplary interior portion 140 is configured to have at least a portion of interior portion 140 to extend at least partially into front unit 160 to secure rear unit 130 with front unit 160. An exemplary interior portion 140 can be configured to extend into front unit 160 for any distance along the axial length of front unit 160. It should be understood that any discussion and disclosure of the first embodiment provided in FIGS. 1-4 which is not presented relative the second embodiment provided in FIGS. 5-6 is understood to be applicable to the second embodiment of FIGS. 5-6 even though not discussed or disclosed.

Referring to FIG. 6, one of various exemplary embodiments of front unit 160 comprises a receiving end 184 formed substantially as a rim. An exemplary embodiment has a first periphery portion 161 extending axially from the receiving end 184 and a second periphery portion 162 extending axially from the first periphery portion 161. The second periphery portion 162 terminates to form a front end 163 of front unit 160. For one of various exemplary embodiments of first and second periphery portions 161 and 162, first and second periphery portions 161 and 162 comprise different respective vertical cross-sectional dimensions. An exemplary first periphery portion 161 has a circular configuration to form a cylinder. An exemplary second periphery portion 162 has a circular configuration with a continually decreasing or diminishing diameter as the second periphery portion 162 extends from the first periphery portion 161 to the front end 163.

Referring to FIGS. 5-6, one of various exemplary embodiments of front unit 160 has a slot 182 extending axially from receiving end 184. Other exemplary embodiments of slot 182 do not begin at receiving end 184, and therefore, begin at any selected spaced distance from receiving end 184. Still other exemplary embodiments of slot 182 terminate at any selected distance from receiving end 184. Alternatively, other exemplary embodiments of slot 182 extend to terminate at any selected distance from front end 163.

Still referring to FIGS. 5-6, one of various exemplary embodiments of projectile 100, an exemplary rear unit 130 includes a substantially solid structure and is configured to remain substantially intact upon impacting a substrate, for example, an animal. An exemplary front unit 160 defines a first cavity 176 beginning at receiving end 184 which includes curved or arcuate internal surfaces 172 and 170 configured to adequately receive at least a section of interior portion 140 of rear unit 130. An exemplary front unit 160 defines an exemplary opening or bore 166 extending axially and in fluid communication from cavity 176 to front end 163. One exemplary configuration of opening 166 has the cross-sectional dimensions (perpendicular to line 9-9) varying along its length (see FIG. 6).

Still referring to FIGS. 5-6, one of various exemplary embodiments of front unit 160 has a plurality of slots 182. An exemplary number of slots 182 include, for example, four slots 182 circumferentially-spaced an equal distance around front unit 160. Alternatively, a plurality of slots 182 are circumferentially-spaced an unequal distance around front unit 160. Furthermore, exemplary slots 182 are configured to extend radially from cavity 176. An exemplary number of slots includes a range of less than two slots to greater than twenty slots, for example, from three slots to eights slots. With respective cavities, slots and bore, an exemplary front unit 60 is configured for fracturing into a plurality of sections upon impacting a substrate, for example, an animal. For the exemplary front unit 160 having four slots 182, front unit 160 will facture into four separate fragments at the time of impact wherein the four fragments become separate and discrete projectiles to increase the trauma and hydro-shock effects on the body of the animal.

It should be understood that front unit 160 can have first and second periphery portions 161 and 162 that are substantially different from those illustrated in FIGS. 5-6. In various other embodiments, front unit 160 can have various round configurations, various pointed configurations and/or ogival configurations, and all various exemplary configurations can have various lengths. Moreover, it should be understood that rear and front units 130 and 160 can comprise the same respective material compositions, or have different respective compositions. Exemplary material compositions for rear and front units 130 and 160 include metals and plastics and various combinations thereof. Various exemplary metals include copper, tin, lead, antimony (Sb) and any combinations or alloys thereof. It should be further understood that vertical cross-sectional dimensions (diameters relative line 9-9) of exterior portion 132 (of rear unit 130) and first periphery 161 (of front unit 160) can comprise the same respective dimensions, or have different respective dimensions. If the respective dimensions are configured differently, one of the two dimensions is configured to support bullet 100 as it travels down the barrel of a firearm.

It should be understood that at least one of the rear and front units 130 and 160 has an outer peripheral configuration dimensioned to be slidingly secured in a barrel of a firearm. Alternatively, both of the rear and front units 130 and 160 have an outer peripheral configuration dimensioned to be slidingly secured in a barrel of a firearm. It should be understood that rear unit 130 can be referred to as a solid structure and front unit 160 can be referred to as a hollow structure.

Figure 10:
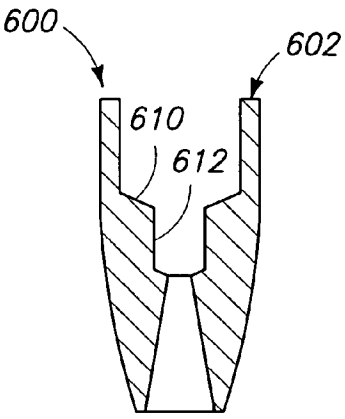
FIG. 10 illustrates the FIG. 9 front unit at an exemplary method step subsequent to the FIG. 9 method step according to one of various embodiments of the invention.
Figure 13:
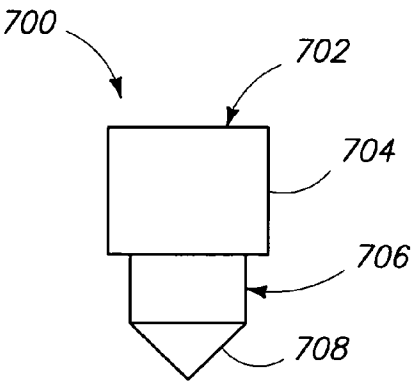
FIG. 13 illustrates the FIG. 12 rear unit at an exemplary method step subsequent to the FIG. 12 method step according to one of various embodiments of the invention.
Figure 12:
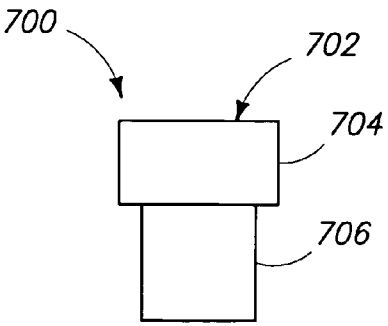
FIG. 12 illustrates the FIG. 11 rear unit at an exemplary method step subsequent to the FIG. 11 method step according to one of various embodiments of the invention.
Figure 11:
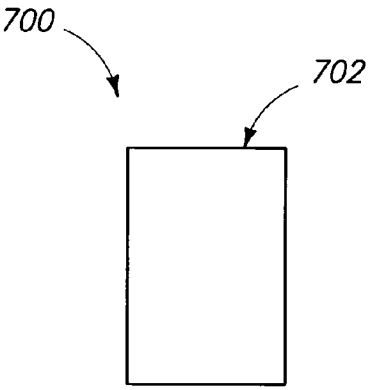
FIG. 11 illustrates a side view of an exemplary preformed rear unit for an exemplary bullet at an exemplary method step of forming same according to one of various embodiments of the invention.

Referring to FIGS. 7-13, exemplary methods 600 and 700 of forming a projectile or bullet according to one of various embodiments of the invention is described. Each exemplary figure represents a step by step shaping process wherein exemplary various methods 600 and 700 include extrusion processing using various dies in a series of stations. FIGS. 7-10 represent a method 600 forming an exemplary front unit and FIGS. 11-13 represent a method 700 of forming an exemplary rear unit. It should be understood that an exemplary front unit can be formed before forming an exemplary rear unit, or vice versa, or an exemplary front unit can be formed substantially simultaneously with forming an exemplary rear unit.

Figure 7:
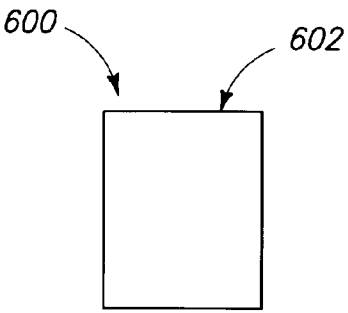
FIG. 7 illustrates a side view of an exemplary preformed front unit for an exemplary bullet at an exemplary method step of forming same according to one of various embodiments of the invention.

Referring to FIG. 7, an exemplary method 600 of forming an exemplary front unit begins. A mass of material 602 is provided. An exemplary mass of material 602 can comprise a metal and/or plastic. An exemplary mass of material 602 can be provided unshaped, and then shaped, for example, into a cylindrical configuration. Alternatively, the mass of material 602 can be provided already shaped, for example, into a cylindrical configuration.

Figure 8:
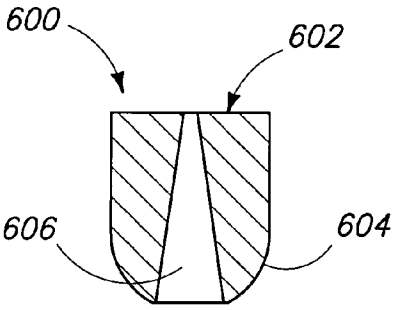
FIG. 8 illustrates the FIG. 7 front unit at an exemplary method step subsequent to the FIG. 7 method step according to one of various embodiments of the invention.

Referring to FIG. 8, an outer periphery 604 at a first end of material 602 is shaped. Additionally, an opening 606 is formed into the first end of material 602. Opening 606 is formed through at least a portion of a length dimension of the material 602. An exemplary opening 606 according to one embodiment of the invention has inner walls of material 602 angled inwardly as opening 606 extends from the first end to an increasing depth in material 602. In another exemplary embodiment of opening 606 includes opening 606 being cylindrical shaped such as a cylindrical bore.

Figure 9:
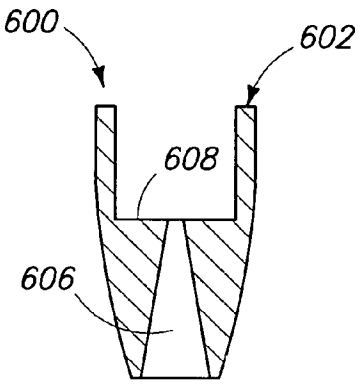
FIG. 9 illustrates the FIG. 8 front unit at an exemplary method step subsequent to the FIG. 8 method step according to one of various embodiments of the invention.

Referring to FIG. 9, a first cavity 608 is formed in a second end of material 602, the second end being opposite the first end. Interior or inner walls of material 602 define the first cavity 608 to have a cylindrical shape.

Referring to FIG. 10, a second cavity 610 is formed to extend from first cavity 608 toward opening 606. Interior or inner walls of material 602 the define second cavity 610 extend inwardly from, that is angled from, the inner walls of the first cavity 608. Furthermore, at least one other cavity, a third cavity 612, is defined by inner walls of material 602 extending from second cavity 610, the third cavity 612 having at least an cylindrical shaped-portion defined by inner walls. An exemplary third cavity 612 provides fluid communication with opening 606.

Referring to FIG. 11, an exemplary method 700 of forming an exemplary front unit begins. A mass of material 702 is provided. An exemplary mass of material 702 can comprise a metal and/or plastic. An exemplary mass of material 702 can be provided unshaped, and then shaped, for example, into a cylindrical configuration. Alternatively, the mass of material 702 can be provided already shaped, for example, into a cylindrical configuration.

Referring to FIG. 12, an exemplary exterior portion 704 of material 702 is formed leaving a section of material 702 as an exemplary interior portion 706. An exemplary exterior portion 704 has a greater lateral dimension (as oriented on the page) than an exemplary lateral dimension of the interior portion 706.

Referring to FIG. 13, interior portion 706 of material 702 is formed or shaped to have a conical configuration 708 extending axially as a front segment of material 702 opposite exterior portion 704. Interior portion 706 and conical configuration 708 are configured to be at least partially received in at least first cavity 608 of the rear unit (FIGS. 7-10). An additional method step includes securing rear unit with front unit wherein at least a portion of interior portion 706 and conical configuration 708 of the rear unit are positioned within at least a portion of the first cavity 608 of the front unit.

Referring to FIG. 14, exemplary dimensions are disclosed for an exemplary rear unit of one of various embodiments for an exemplary projectile or bullet according to the invention. An exemplary dimension represented by "A" equals about 0.7 inch. An exemplary dimension represented by "B" equals about 0.4 inch. An exemplary dimension represented by "C" equals about 0.3 inch. An exemplary caliber of rear unit is 0.375.

Figure 15:
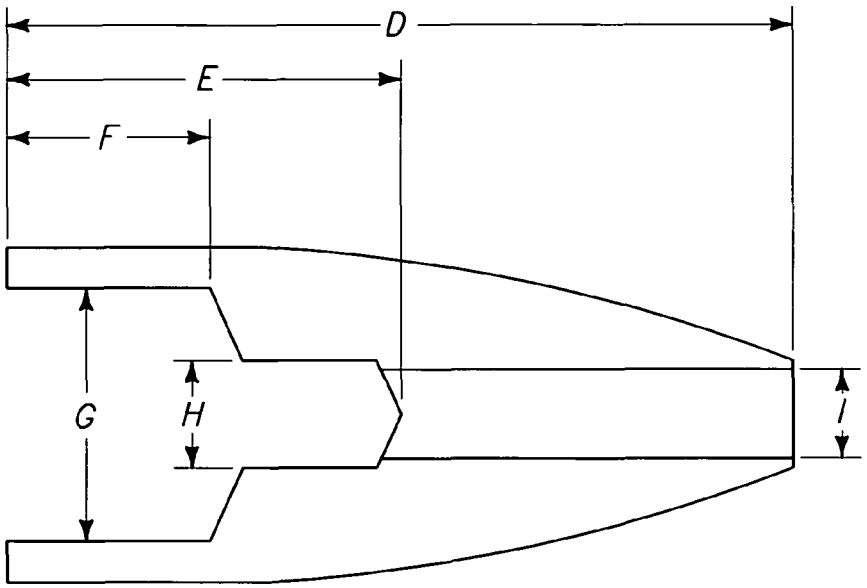
FIG. 15 illustrates a cross-sectional view of an exemplary front unit of an exemplary bullet and demonstrating exemplary dimensions for the front unit according to one of various embodiments of the invention.

Referring to FIG. 15, exemplary dimensions are disclosed for an exemplary front unit of one of various embodiments for an exemplary projectile or bullet according to the invention. An exemplary dimension represented by "D" equals about 0.9 inch. An exemplary dimension represented by "E" equals about 0.45 inch. An exemplary dimension represented by "F" equals about 0.2 inch. An exemplary dimension represented by "G" equals about 0.3 inch. An exemplary dimension represented by "H" equals about 0.14 inch. An exemplary dimension represented by "I" equals about 0.078 inch. An exemplary caliber of front unit is 0.375.

Figure 16:
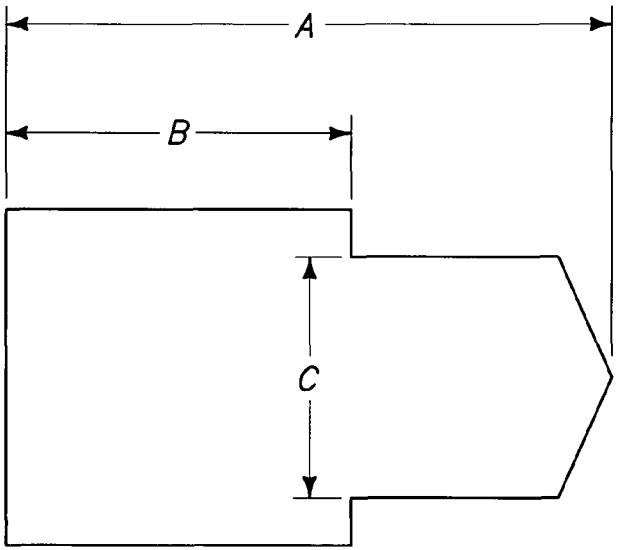
FIG. 16 illustrates a side elevational view of an exemplary cartridge with an exemplary bullet according to one of various embodiments of the invention.
Figure 16:
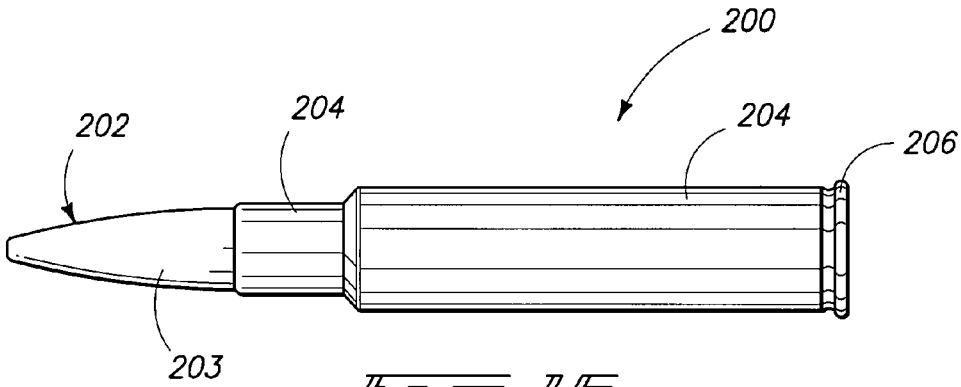

Referring to FIG. 16, an exemplary cartridge 200 is illustrated that incorporates one of various embodiments of an exemplary projectile or bullet 202 according to the invention. It should be understood that cartridge 200 can be configured for any caliber. The exemplary bullet 202 has a front unit 203 and a rear unit (not shown as being secured in structure of cartridge 200 discussed below). At least a portion of the rear unit is secured in front unit 203 as described previously. Accordingly to one of various embodiments of an exemplary cartridge 200, bullet 202 is secured in an open end of an exemplary casing 204. That is, the open end of casing 204 is filled with bullet 202. Casing 204 includes a rim 206 at a base opposite the open end provided with bullet 202. Within casing 204 between bullet 202 and rim 206 is an explosive (not shown) such as gunpowder and/or cordite which serves as a propellant for bullet 202. Additionally, the exemplary embodiment of cartridge 200 includes a primer (not shown) in rim 206 and configured in igniting relationship with the propellant.

Referring to FIGS. 17-22, an exemplary method of using cartridge 200 and bullet 202 of FIG. 16 is illustrated according to one of various embodiments of the invention. Moreover, the results are compared to results of using a conventional cartridge and bullet (not shown). All factors during the comparison were maintained the same or provided to be equal for each method of use. For example, the same amount and type of propellant were used in respective cartridges to provide the same velocity of respective bullets upon firing from the barrel of the same conventional rifle. The same distance of the rifle barrel from an exemplary substrate was provided with all other environmental factors being the same, such as temperature. That is, all factors were the same except for the differences between the conventional bullet (not shown) and the inventive bullet 202.

Figure 17:
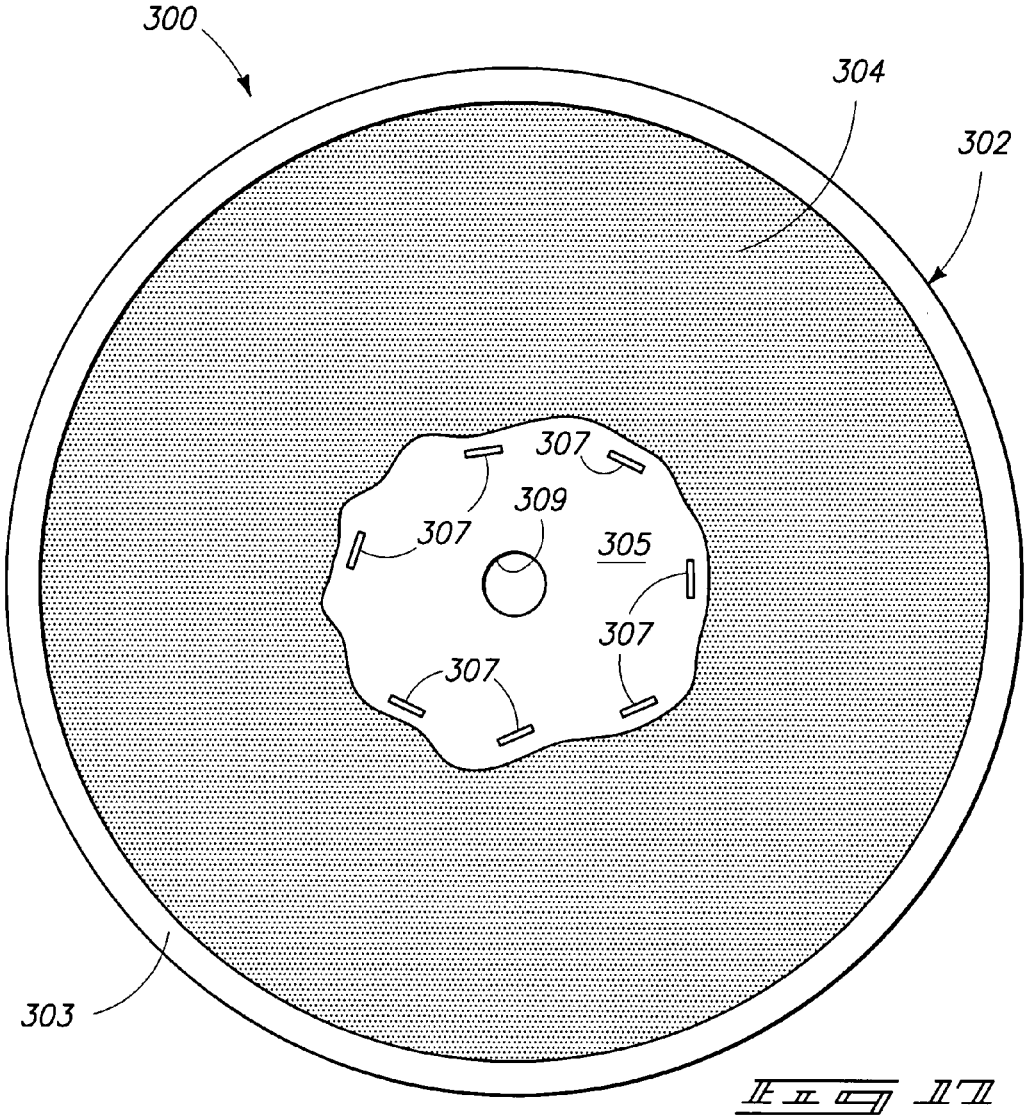
FIG. 17 illustrates an exemplary substrate to be used for impacting with the FIG. 16 inventive bullet according to one of various embodiments of the invention, and for comparison, the exemplary substrate is also to be used for impacting with a conventional bullet.

Referring to FIG. 17, an exemplary substrate 300 to be penetrated is sand 304 provided in a container or tank 302. An exemplary container 302 has a rim 303 and holds a volume of twenty gallons. An exemplary substrate 300 further includes a leather or cardboard portion 305 positioned over an upper surface of several inches of sand 304. The upper surface of sand 304 is substantially planar and level with rim 303 of container 302. An exemplary leather portion 305 includes hide from an animal, for example, a deer. An exemplary leather portion 305 has a target region 309 and is secured on the upper surface of sand 304 by retainer members 307.

Figure 18:
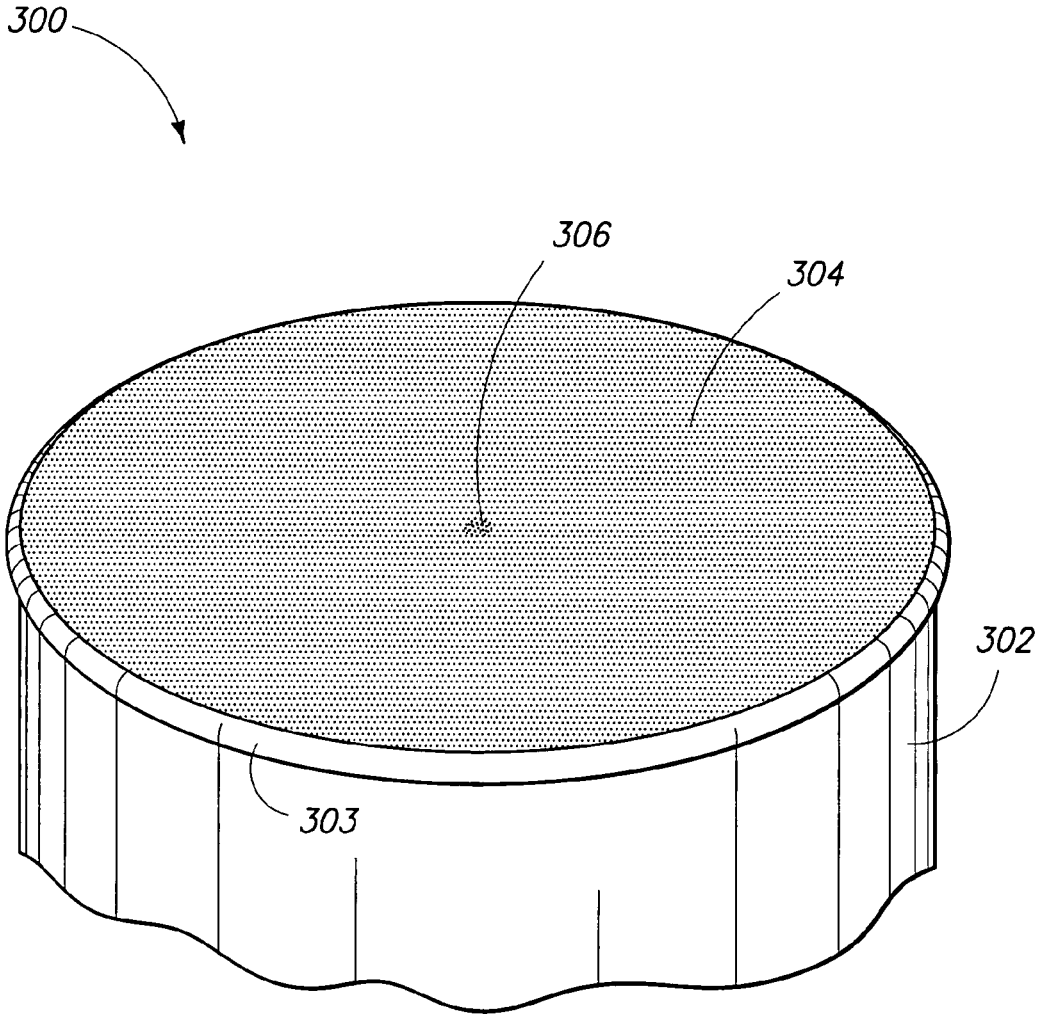
FIG. 18 illustrates the substrate of FIG. 17 after being impacted by a conventional bullet.

Referring to FIG. 18, the conventional bullet is fired from the conventional rifle into the exemplary substrate 300 for comparison with inventive bullet 202. The conventional bullet is a Barnes bullet, .375 caliber, 250 grn flat base. The conventional rifle is a Mannlicher Schoenauer .375-06 wild cat. The end of the barrel of the rifle was positioned approximately three feet from substrate 300. The impact site 306 for the conventional bullet is a bullet hole in sand 304 wherein no crater or impact site larger than a bullet hole was formed in the sand 304. The impact site 306 represents the energy being transferred from the conventional bullet to the substrate 300 of sand 304.

Figure 19:
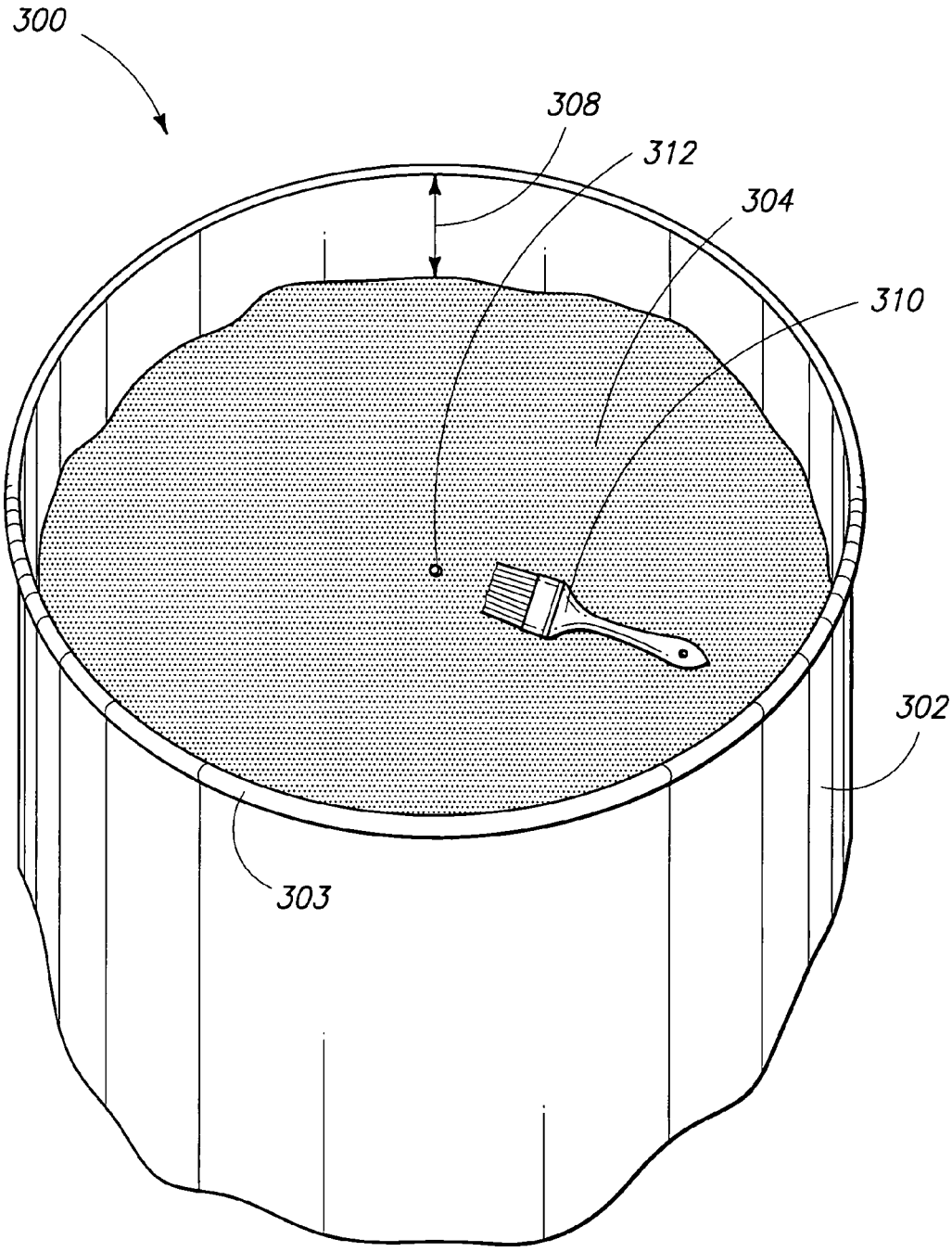
FIG. 19 illustrates the substrate of FIG. 18 with portions removed to locate the conventional bullet.

Referring to FIG. 19, the conventional bullet 312 was located straight down into the sand 304 from the impact site 306 (FIG. 18) by brushing the sand 304 from the impact site 306 with a brush 310. The conventional bullet 312 was located approximately a distance 308 of eight inches into the sand 304 from rim 303 of container 302. The expanded size of the conventional bullet 312 was approximately 242 $mm^2$ in area. The weight retention after impact of the conventional bullet 312 was approximately 100%.

Figure 20:
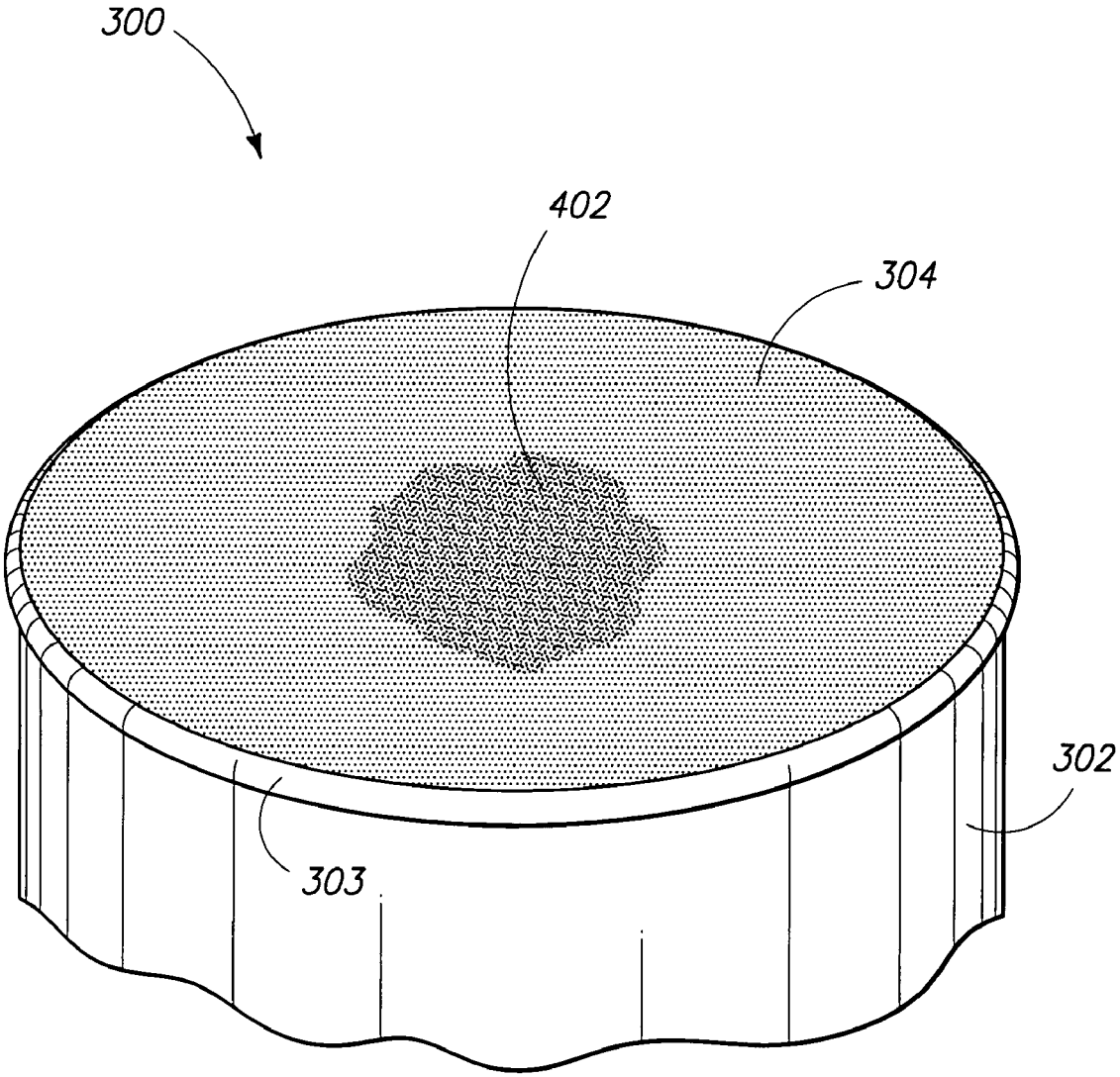
FIG. 20 illustrates the substrate of FIG. 17 after being impacted by the inventive bullet of FIG. 16 according to an exemplary embodiment of the invention.

Referring to FIG. 20, cartridge 200 was provided in the same conventional rifle, the Mannlicher Schoenauer .375-06 wild cat, and bullet 202 was fired into substrate 300 under the same conditions as the firing of the conventional bullet discussed relative to FIGS. 17-19. Bullet 202 created an impact site 402 formed as a crater 402 and having dimensions substantially larger than the bullet hole (impact site 306) created by the conventional bullet. The impact site 402 represents the energy being transferred from bullet 202 to the substrate 300 of sand 304.

Moreover, the size, shape and dimensions of impact site 402 represent a massive quantity of energy being transferred from bullet 202 to substrate 300 relative the energy transferred by the conventional bullet represented by the small bullet hole (impact site 306) in sand 304. The comparisons of the respective quantities of energy transferred from respective bullets to substrate 300 demonstrates the substantial increase in trauma and hydro-shock effects that will occur in an animal impacted by bullet 202 as opposed to the impact provided by the conventional bullet. Accordingly, the use of bullet 202 will facilitate the goal of consistently incapacitating an animal quickly, humanely and permanently allowing for capture and harvest of the animal. The crater 402 created by bullet 202 had a diameter of about 7¾ inches and a depth of about ¾ inch deep into sand 304 from rim 303 of container 302.

Figure 21:
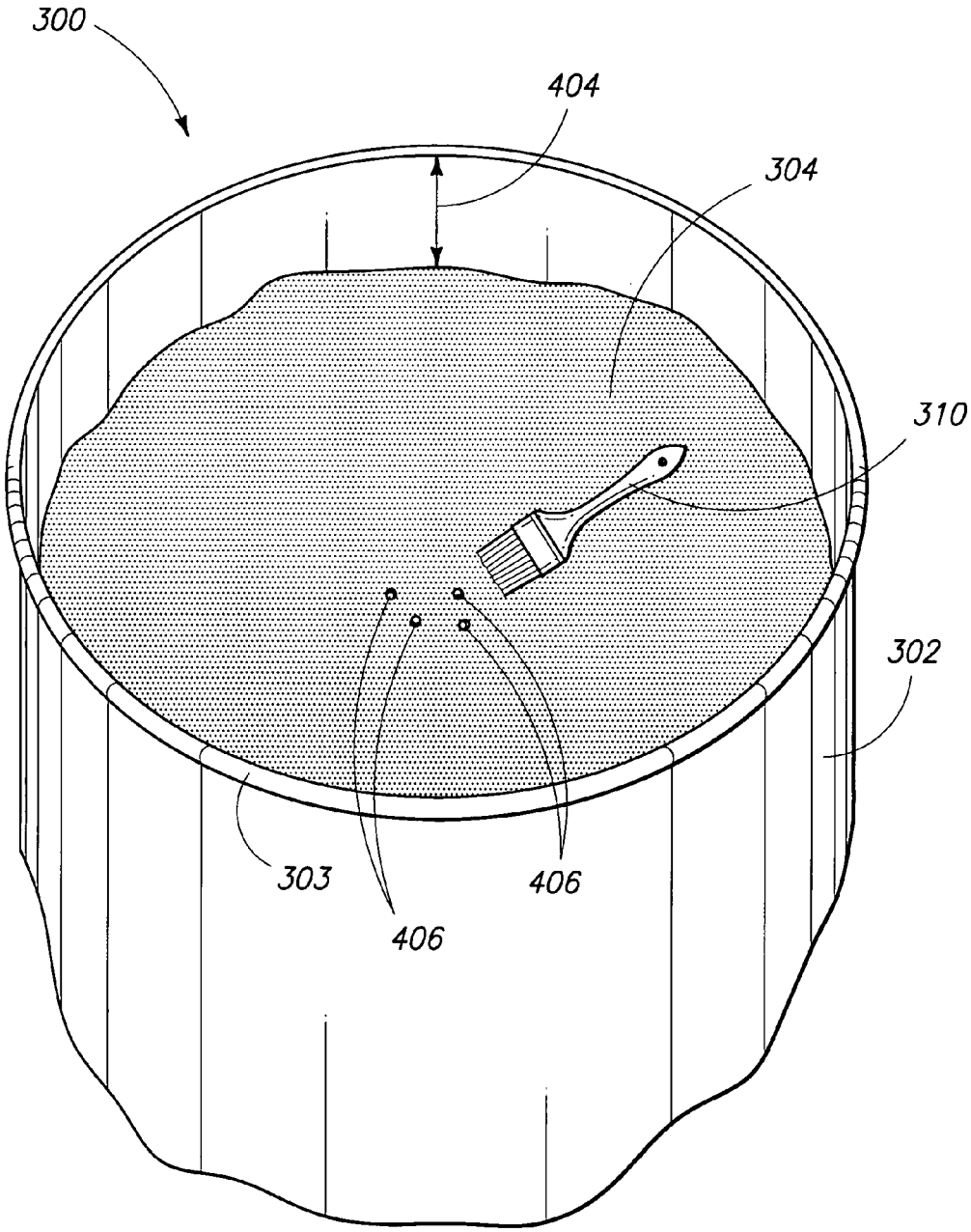
FIG. 21 illustrates the substrate of FIG. 20 with portions of the substrate removed to locate the exemplary front unit of the inventive bullet of FIG. 16.

Referring to FIG. 21, using bullet 202 according to one of various embodiments of the invention results in the exterior or front unit 203 separating into a plurality of bullet fragments 406 upon impact with substrate 300. A metal detector (not shown) and brush 310 were used to locate and recover the bullet fragments 406 which originated from the front unit 203 of bullet 202. The plurality of bullet fragments 406 were located and comprised four bullet fragments 406. Each of the plurality of bullet fragments 406 was substantially uniform in size and mass. The plurality of bullet fragments 406 were located at a distance 404 of from about 6½ inches to about seven (7) inches deep into the sand 304 from rim 303 of container 302. The plurality of bullet fragments 406 formed a spread pattern of from about two (2) inches to about four (4) inches apart from one another.

Figure 22:
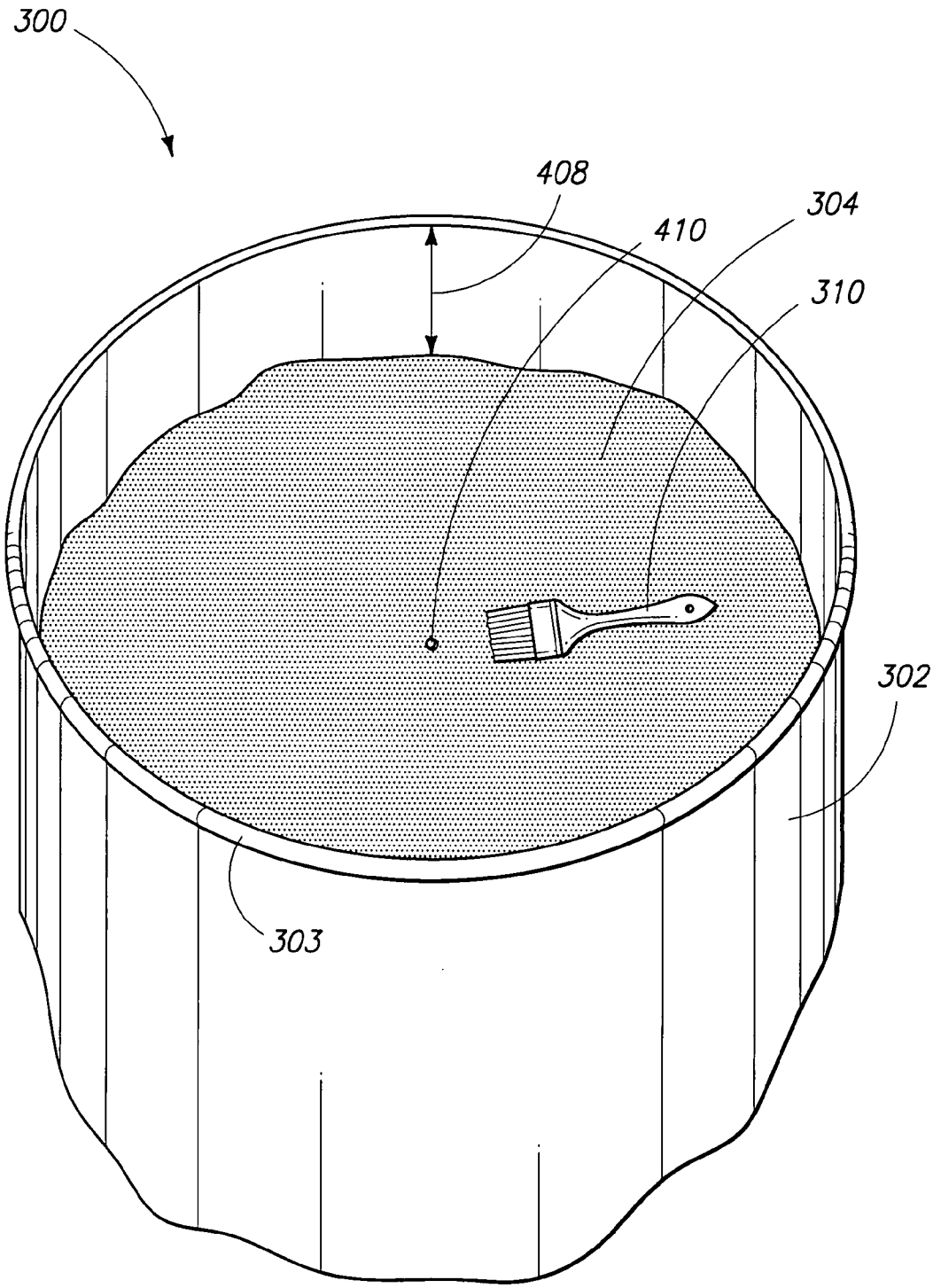
FIG. 22 illustrates the substrate of FIG. 21 with portions of the substrate removed to locate the exemplary rear unit of the inventive bullet of FIG. 16.

Referring to FIG. 22, the interior or rear unit 410 (not shown in FIG. 16 since contained in case 204) continues to penetrate deeper into the sand 304 than the plurality of bullet fragments 406 (FIG. 21). The rear unit 410 penetrates into the sand 304 straight down from the impact site 402 to a distance 408 of about 8¼ inches from rim 303 of container 302 and without significant deformation.

Figure 23:
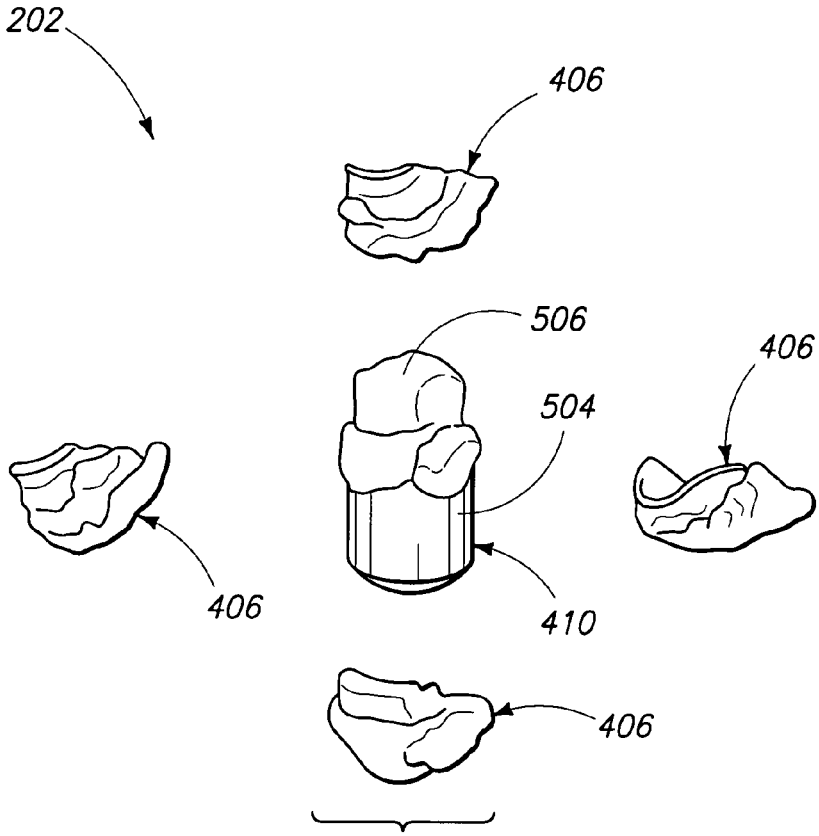
FIG. 23 illustrates the exemplary inventive bullet of FIG. 16 after impacting the substrate of FIG. 17.

Referring to FIG. 23, rear unit 410 and the plurality of bullet fragments 406 from front unit 203 of bullet 202 are shown. Rear unit 410 has not had a substantial mass loss which is conducive to further penetration into an exemplary substrate, such as wildlife for harvest. The diameter of rear unit 410 is substantially uniform throughout its length after the impact with substrate 300 as evidenced by the limited expansion in its diameter. Additionally, the limited expansion in the diameter of rear unit 410 allows rear unit 410 to substantially maintain its aerodynamics after impact which facilitates further penetration of rear unit 410 into an exemplary substrate. That is, the diameter of base 504 of rear unit 410 is substantially the same as the diameter of the impacted portion 506. The additional penetration by rear unit 410 increases the potential of additional trauma and hydro-shock occurring in the animal. The expanded area of rear unit 410 is about 344 $mm^2$.

Figure 24:
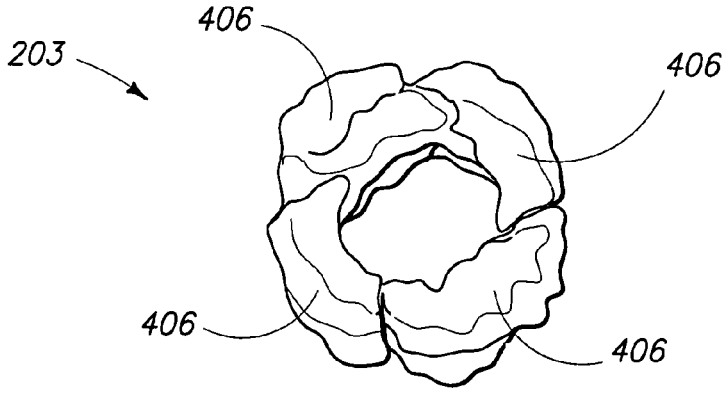
FIG. 24 illustrates the exemplary plurality of fragments of the inventive front unit from the inventive bullet of FIG. 16 after impacting the substrate of FIG. 17.

Referring to FIG. 24, the plurality of bullet fragments 406 are mated together to demonstrate the bullet fragments 406 are substantially of equal size, equal mass and equal configuration. Since bullet 202 will spin at about 200,000 rpm upon firing from the barrel of the rifle, the bullet fragments 406 that develop upon impact will travel in separate directions and act as cutting blades of a meat grinder to create massive trauma shock in the animal's body.

Moreover, with the bullet fragments 406 traveling in separate directions, and simultaneously spreading out in the separate directions, the chances of an "empty chamber shot" occurring are greatly reduced. It should be understood that once bullet 202 impacts an animal, front unit 203 will diminish in velocity while rear unit 410 continues to move forward and slide into front unit 203 to facilitate fracturing front unit 203 into the plurality of bullet fragments 406. With the bullet fragments 406 traveling in different directions, the probability exists for one or two bullet fragments 406 to travel upward and impact the spine bone causing immediate death. Moreover, the probability exists for one or two bullet fragments 406 to travel downward and impact the lungs which will cause significant trauma shock to incapacitate the animal close to the impact site.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A bullet for a firearm comprising:

a rear unit comprising a substantially solid structure having a forward-most portion, the forward-most portion comprising a point configuration;

a front unit separate and discrete from the rear unit, the front unit defining a cavity, at least a portion of the rear unit comprising the point configuration is secured in the cavity of the front unit; and wherein the front unit defines a plurality of slots extending radially from the cavity and circumferentially-spaced around a periphery of the front unit, the plurality of slots extending from the cavity through an entirety of the front unit to the exterior of the bullet.

2. The bullet of claim 1, wherein the front unit defines an opening extending through an entire length of the front unit, a portion of the opening defined by the cavity.

3. The bullet of claim 1, wherein the front unit defines a plurality of slots extending axially from a first end toward an opposite second end of the front unit.

4. The bullet of claim 1, wherein the rear unit comprises at least three portions, the at least three portions comprising:

a first portion comprising a conical configuration wherein the terminus of the conical configuration comprises the point configuration;

a second portion extending from the first portion, the second portion comprising a cylindrical configuration having a first diametric dimension; and a third portion extending from the second portion, the third portion comprising a cylindrical configuration having a second diametric dimension different from the first diametric dimension of the second portion.

5. The bullet of claim 4, wherein the first diametric dimension is less than the second diametric dimension.

6. The bullet of claim 1, wherein the cavity is configured as a cylindrical opening.

7. The bullet of claim 1, wherein the cavity is configured as a first cylindrical opening and a second cylindrical opening, the first cylindrical opening having a first diametric dimension and the second cylindrical opening having a second diametric dimension, wherein the first diametric dimension is greater than the second diametric dimension.

8. The bullet of claim 7, wherein the cavity is further configured with a tapered portion extending between the first and second cylindrical openings.

9. The bullet of claim 1, wherein the plurality of the slots is devoid of material.

* * * * *

UNITED STATES PATENT AND TRADEMARK OFFICE

CERTIFICATE OF CORRECTION

PATENT NO. : 8,307,768 B2
APPLICATION NO. : 11/709510
DATED : November 13, 2012
INVENTOR(S) : Joseph L. Cziglenyi It is certified that error appears in the above-identified patent and that said Letters Patent is hereby corrected as shown below:

In the Specification

Column 5, line 17 – Replace "ground unconsciousness" with --ground unconscious--

Column 5, line 26 – Replace "be implement" with --be implemented--

Column 6, line 7 – Replace "to positioned" with --to be positioned--

Column 6, line 35 – Replace "unit 60 is position" with --unit 60 is positioned--

Column 7, line 15 – Replace "are defines by" with --are defined by--

Column 7, line 28 – Replace "different configuration" with --different configurations--

Column 7, line 47 – Replace "to eights slots" with --to eight slots--

Column 7, line 52 – Replace "to facture into" with --to fracture into--

Column 10, line 3 – Replace "to eights slots" with --to eight slots--

Column 10, line 8 – Replace "will facture into" with --will fracture into--

Column 11, line 11 – Replace "the define second cavity 610 extend" with --define the second cavity 610 to extend--

Column 13, line 30 – Replace "pattern of from" with --pattern from--

Signed and Sealed this
Seventeenth Day of September, 2013

Teresa Stanek Rea

Teresa Stanek Rea
*Deputy Director of the United States Patent and Trademark Office*